US005267837A

United States Patent [19]

Mowli

[11] Patent Number: 5,267,837

[45] Date of Patent: Dec. 7, 1993

[54] TWO-STAGE PUMPING APPARATUS WITH NON-MESHING FIRST STAGE AUGERS

[76] Inventor: John C. Mowli, 640 Sanders Ct., Gurnee, Ill. 60031

[21] Appl. No.: 950,649

[22] Filed: Sep. 23, 1992

[51] Int. Cl.[5] ..... F04B 15/02; F04C 2/10

[52] U.S. Cl. ..... 417/53; 417/203; 417/205; 417/900

[58] Field of Search ..... 417/203, 205, 900, 53; 425/208

[56] References Cited

U.S. PATENT DOCUMENTS

| | | | |
|---|---|---|---|
| Re. 18,527 | 7/1932 | Simmons . | |
| 1,164,546 | 12/1915 | Neuland . | |
| 2,358,815 | 9/1944 | Lysholm . | |
| 2,543,894 | 3/1951 | Colombo . | |
| 2,592,476 | 4/1952 | Sennet . | |
| 2,889,574 | 6/1959 | Thielen et al. . | |
| 2,966,698 | 1/1961 | Thielen . | |
| 2,975,963 | 3/1961 | Nilsson . | |
| 2,994,562 | 8/1961 | Zalis . | |
| 3,072,624 | 1/1963 | Akaboshi et al. . | |
| 3,147,784 | 9/1964 | Sloan . | |
| 3,198,132 | 8/1965 | Zalis . | |
| 3,279,682 | 10/1966 | Vagenius . | |
| 3,467,300 | 9/1969 | Schibbye . | |
| 3,481,532 | 12/1969 | Fraser . | |
| 3,582,244 | 6/1971 | Siclari . | |
| 3,734,635 | 5/1973 | Blach et al. . | |
| 3,807,911 | 4/1974 | Caffrey . | |
| 3,817,496 | 6/1974 | Kratochvil et al. . | |
| 3,900,187 | 8/1975 | Loomans . | |
| 4,017,241 | 4/1977 | Papinchak et al. . | |
| 4,132,845 | 1/1979 | Covington, Jr. et al. . | |
| 4,529,363 | 7/1985 | Suzuki . | |
| 4,787,826 | 11/1988 | Schnell . | |
| 4,792,294 | 12/1988 | Mowli . | |
| 4,944,657 | 7/1990 | Mowli . | |
| 5,118,251 | 6/1992 | Saulgeot | 417/203 X |

FOREIGN PATENT DOCUMENTS

| | | |
|---|---|---|
| 0250735 | 1/1988 | European Pat. Off. . |
| 967196 | 10/1950 | France . |
| 2025983 | 9/1970 | France . |

OTHER PUBLICATIONS

Doering Pump Feeders, Jun. 1981 (4 Sheets).
CFP-Continuous Filter Press (2 Sheets).
Luwa Polymer Technology HS-19 (12 Sheets).

*Primary Examiner*—Richard E. Gluck
*Attorney, Agent, or Firm*—Dressler, Goldsmith, Shore & Milnamow, Ltd.

[57] ABSTRACT

A two-stage pumping apparatus is provided with a pump housing through which gross movement of material occurs generally from an infeed opening to a discharge opening. The first stage includes two non-positive displacement helical flight augers which each rotate about respective, spaced-apart, parallel axes. The upstream end of one of the first stage augers terminates axially downstream of the downstream end of the other first stage auger helical flights. The helical flights of the upstream first stage auger extend laterally over at least a portion of the adjacent first stage auger. The first stage augers are coaxial with, and cooperate with, a pair of second stage augers which each have a positive displacement helical flight for engaging the material and for being respectively intermeshed to provide positive displacement pumping.

20 Claims, 5 Drawing Sheets

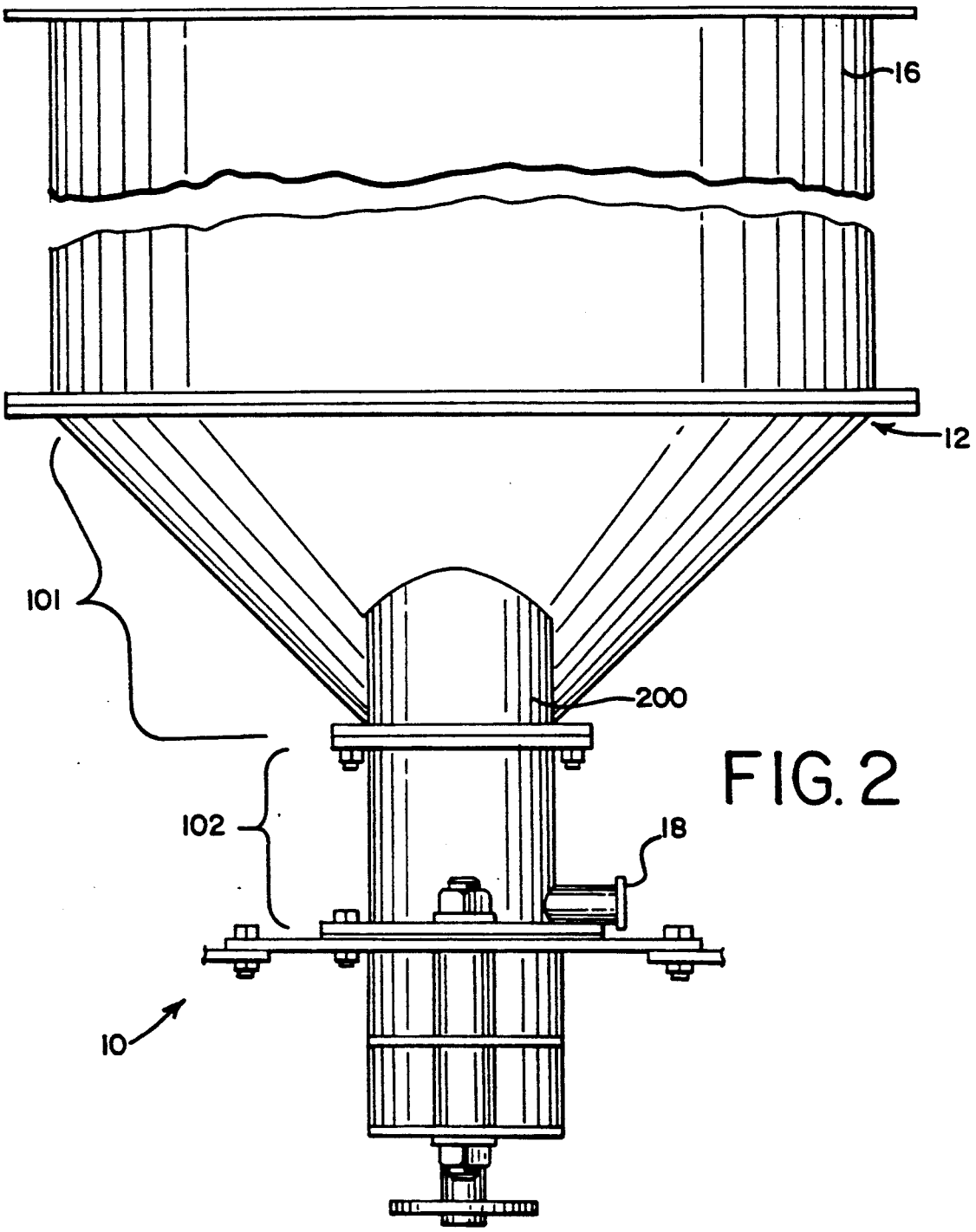
FIG. 2
FIG. 3
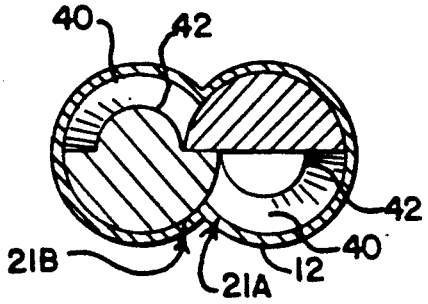

TWO-STAGE PUMPING APPARATUS WITH NON-MESHING FIRST STAGE AUGERS

TECHNICAL FIELD

The present invention relates generally to a pumping apparatus including a pair of screw augers, and more particularly to a two-stage pumping apparatus particularly suited for pumping highly viscous liquids, semi-solids and like materials which otherwise are not readily pumped.

BACKGROUND OF THE INVENTION AND TECHNICAL PROBLEMS POSED BY THE PRIOR ART

Commercial preparation of many different food and non-food products requires the use of pumping equipment suited for pumping materials which do not readily flow or are otherwise difficult to pump. For example, food products such as cheeses, lards and shortenings, ground meat, sugars, and doughs typically require the use of specialized, multi-stage pumping devices for effecting desired movement of such materials. Similarly, non-food products such as adhesives, soaps, putties and caulking compounds, and the like require the use of specialized pumping equipment if efficient handling is to be achieved.

A pumping apparatus is disclosed in U.S. Pat. No. 4,792,294. This apparatus has been found to effectively pump products which do not readily flow and for which the pump is particularly well suited. The pumping apparatus includes a pair of cooperating, counter-rotating screw augers within a housing. Each of the screw augers includes helical flights intermeshed with the flights of the other auger, and the flights are configured to provide a two-stage pumping action—namely, (1) a first, upstream, non-positive displacement pumping, and (2) a second, downstream, positive displacement pumping.

The U.S. Pat. No. 4,944,657 discloses a two-stage pump which is especially suitable for materials which can, under some conditions, undergo a change in character, consistency, or other material properties. With some products, significant changes in properties may be characterized as a loss of product integrity which is of such a nature as to render the product commercially unacceptable.

The pumping apparatus described in U.S. Pat. No. 4,944,657 provides an improved pumping apparatus for use with materials that are particularly shear sensitive so as to eliminate, or at least substantially reduce, the application of excessive shear strain on the material which might cause it to change its material characteristics.

While the above-discussed pump designs provide advantageous pumping characteristics in particular applications, there is a need to provide improved pumping apparatus for use in those applications wherein it is beneficial to minimize the pressure drop to which the material is subjected owing to changes in direction of flow from the first stage to the second stage.

It would also be desirable to provide an improved pumping apparatus which would advantageously accommodate easier assembly and disassembly.

The pumping apparatus of the present invention can be operated to effect an improved pumping process, and can be embodied in a design exhibiting the above-discussed benefits and features.

SUMMARY OF THE INVENTION

In accordance with the present invention, a two-stage pumping apparatus is provided with a pump housing through which material is pumped. The housing defines (1) a material infeed opening, (2) a first stage non-positive displacement pumping region communicating with the infeed opening, (3) a second stage positive displacement pumping region downstream of, and communicating with, the non-positive displacement pumping region, and (4) at least one material discharge opening communicating with the second stage region.

In the first stage region there is provided first and second auger means which are each rotatable about respective parallel axes for moving material along the first stage auger means. The first stage auger means each have a non-positive displacement helical flight means for providing a non-positive displacement pumping action and a net positive suction head at the interface of the first and second stage regions.

The effective portion of the first stage first auger means is axially displaced relative to the first stage second auger means. The upstream end of the helical flight means of the first stage second auger means terminates axially downstream of the helical flight means of the first stage first auger means. Further, the helical flight means of the first stage first auger means extends laterally over at least a portion of the first stage second auger means.

According to another aspect of the present invention, a method is provided for pumping material which flows with difficulty. The material is introduced into an infeed opening of a housing that has infeed and discharge openings generally at opposite ends and through which material is pumped. A first helical flight means is rotated about a first axis for engaging the material in a first stage region of the housing. A second helical flight means is rotated for engaging the material in the first stage region of the housing with the second helical flight means located (1) to rotate about a second axis spaced from, and parallel to, the first axis and (2) lower than, and partially under, a portion of the first helical flight means.

The material is moved through the first stage region to a second stage region by the action of the first and second helical flight means effecting a non-positive displacement pumping. Thereafter, the material is moved through the second stage region by rotating a pair of helical flight means for engaging the material in the second stage region to effect positive displacement pumping. Thereafter, the material is discharged through the discharge opening.

The pumping method can be effected in a pumping apparatus so as to minimize or reduce the pressure drop to which the material is subjected compared to certain low shear designs such as disclosed in the above-discussed U.S. Pat. No. 4,944,657. The lower pressure drop is obtained by operating the first stage first auger means to direct some of the material directly over the upstream end of the first stage second auger means without significantly changing the direction of flow.

Further, because the helical flight means of the first stage first and second auger means do not intermesh, assembly and disassembly of the pumping apparatus is easier than with pumps wherein intermeshing flights are provided.

In the second stage region there are first and second positive displacement auger means rotatable together about respective parallel axes for moving the material along the second stage auger means from the first stage region downstream to the material discharge opening. Each second stage auger means has positive displacement helical flight means configured within the pump housing for engaging the material and for being respectively intermeshed with the positive displacement helical flight means of the other one of the second stage auger means for providing positive displacement pumping.

A drive means is provided for rotatably driving the second stage auger means and the first stage auger means.

BRIEF DESCRIPTION OF THE DRAWINGS

FIG. 2 is a fragmentary, side-elevational view taken generally along the plane 2—2 in FIG. 1;

FIG. 3 is a cross-sectional view taken generally along the plane 3—3 in FIG. 1.

DETAILED DESCRIPTION OF THE PREFERRED EMBODIMENT

Figure 1:
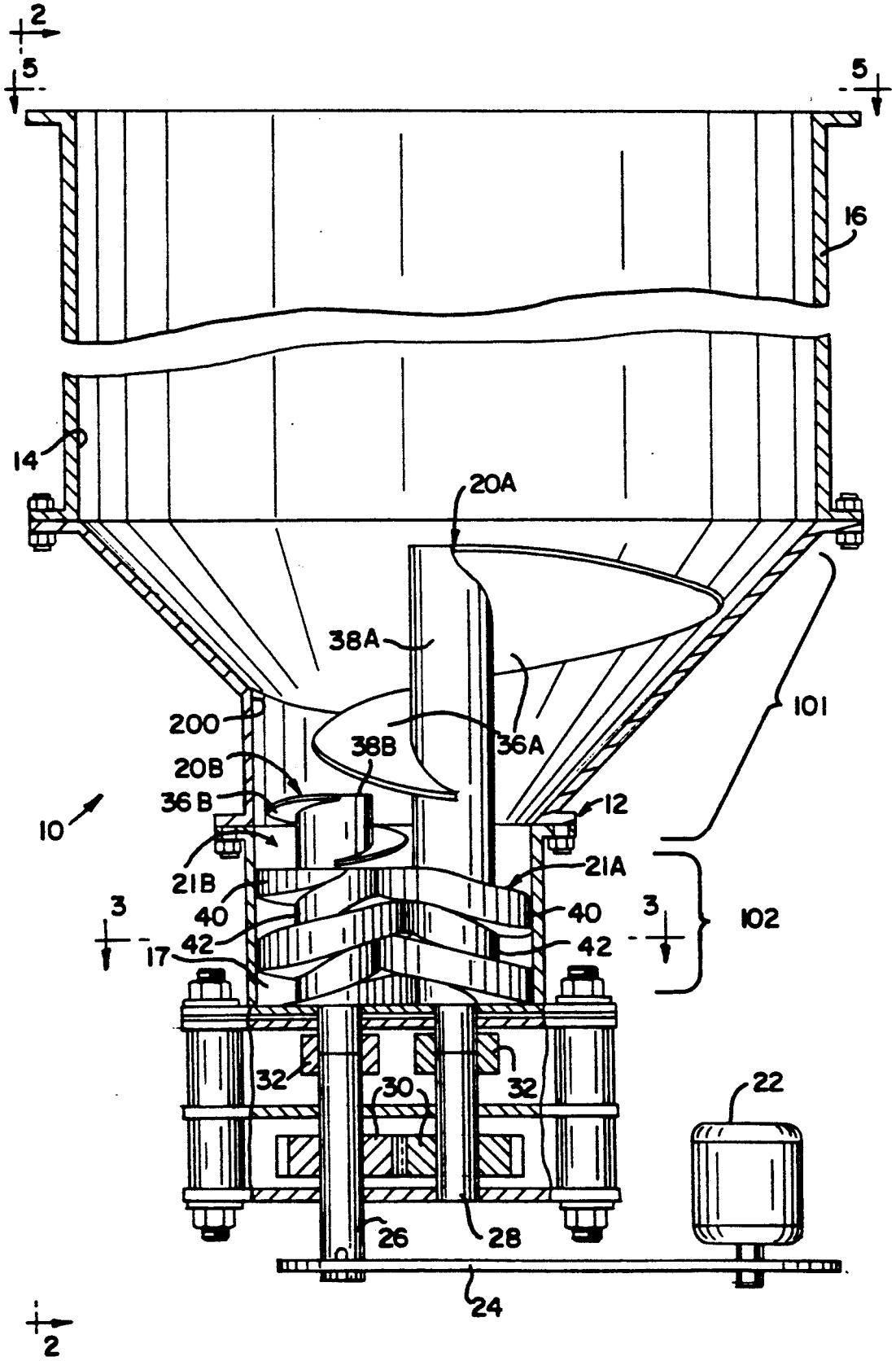
FIG. 1 is a diagrammatic, simplified, elevational view, partially in cross-section, of a two-stage pumping apparatus embodying the principles of the present invention.
Figure 4:
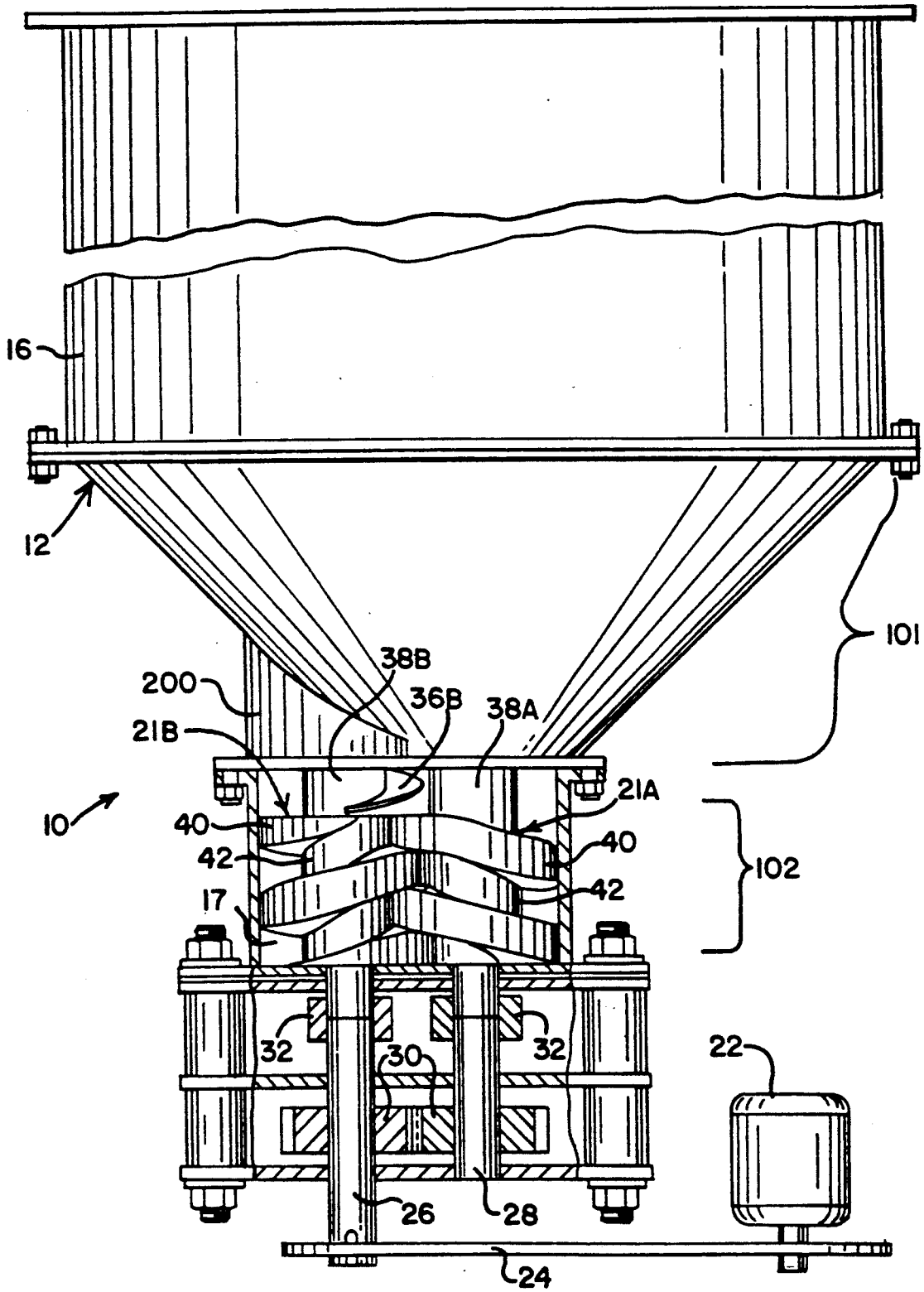
FIG. 4 is a view similar to FIG. 1, but showing the exterior of the first stage housing.
Figure 5:
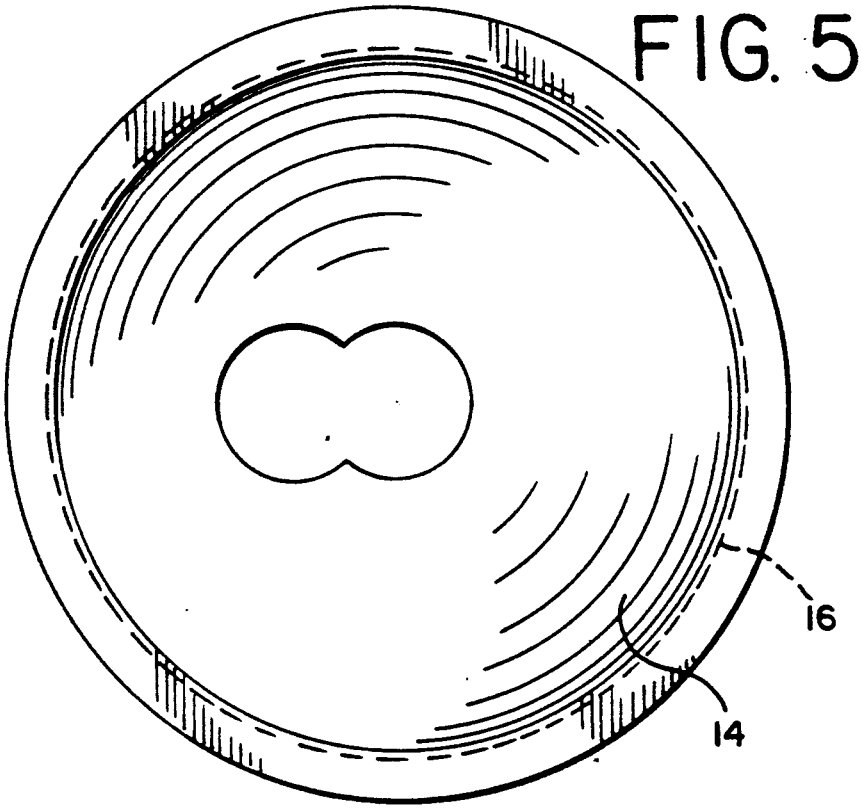
FIG. 5 is a top plan view taken generally along the plane 5—5 in FIG. 1 but with the auger means 20A and 20B omitted to show the underlying detail.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiments illustrated.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, and sold in an orientation other than the position described.

The apparatus of this invention is used with certain conventional components, including drive mechanisms and control mechanisms, the details of which, although not fully illustrated or described, will be apparent to those having skill in the art and in understanding of the necessary functions of such components.

Some of the figures illustrating the embodiment of the apparatus show structural details and mechanical elements that will be recognized by one skilled in the art. However, the detailed descriptions of such elements are not necessary to an understanding of the invention, and accordingly, are not herein presented.

Referring first to FIGS. 1-4, there is illustrated a two-stage pumping apparatus 10 embodying the principles of the present invention. Notably, the pumping apparatus 10 is arranged for gravity infeed of material to be pumped, thus desirably promoting feeding of materials that otherwise may tend to resist movement into and through the pumping apparatus.

To this end, the apparatus 10 includes a pump housing 12 through which the material is pumped. In the preferred embodiment, the pump housing 12 is generally vertically oriented, and the gross movement of material occurs generally in the direction of gravity. The housing 12 defines a material infeed opening 14 generally at its upper end through which material is introduced into the apparatus 10, and the housing 12 has at least one material discharge opening 18 (FIG. 2).

The pump housing 12 also defines a first stage non-positive displacement pumping region 101 communicating with the infeed opening 14 and defines a second stage positive displacement pumping region 102 downstream of, and communicating with, the first stage region 101.

If desired, the apparatus 10 can be provided with an associated infeed hopper 16 extending generally upwardly from the infeed opening 14 for holding material being introduced by gravity into the pumping apparatus 10.

Movement of material through the pumping apparatus 10 is generally downwardly through pump housing 12 into a pressurized discharge cavity 17. Material is moved out of the apparatus 10 via the discharge opening 18 defined by the pump housing 12 in communication with the discharge cavity 17. While a single, generally centrally disposed discharge opening 18 is illustrated, it will be appreciated that a pump in accordance with the present teachings may instead include two or more spaced-apart discharge openings positioned generally in the lower region of the pump housing in communication with the discharge cavity 17.

Since material in the discharge cavity is continuously pressurized attendant to pump operation, two or more "streams" of material can readily be formed (by the provision of a corresponding number of discharge openings) without resort to additional flow dividers or the like. Thus, a single pumping apparatus 10 can readily be employed to supply material to more than one associated processing stream.

Movement of material generally downwardly through pump housing 12 is effected in the first stage region 101 by a first stage first auger means 20A and a first stage second auger means 20B. Movement of the material is effected in the second stage region 102 by a second stage first auger means 21A and a cooperating second stage second auger means 21B. Both second stage auger means 21A and 21B are screw-type augers that are preferably generally mirror images of each other and are arranged for cooperating, counter-rotation about respective parallel axes within second stage region 102 of the pump housing 12. However, they could be designed for rotation in the same directions.

The interior of housing 12 in the second stage region 102 is preferably constructed to closely conform to the peripheral configuration of the pair of intermeshed auger means 21A and 21B to promote efficient material movement (see FIG. 3).

The illustrated embodiment of the present pumping apparatus 10 is arranged such that drive of the auger means 21A and 21B is effected generally at the downstream ends of the auger means 21A and 21B. Driving of the auger means 21A and 21B may be effected by means of a suitable drive motor 22 which can be operatively connected with the auger means 21A and 21B such as by a drive belt or chain 24 extending to a driven stub shaft 26. An additional stub shaft 28 can be employed, with meshed, interconnecting gears 30 respectively affixed to the stub shafts 26 and 28 whereby opposite, concurrent rotation is effected.

Each of the stub shafts 26 and 28 is operatively connected with a respective one of the auger means 21A and 21B such as by means of a suitable drive coupling 32. Suitable conventional bearings and seals, not shown, are ordinarily employed for rotatably supporting the various components, and for sealing the interior of the pump housing 12 against leakage.

In this latter regard, it should be noted that the manner in which the auger drive system is operatively connected with the auger means 21A and 21B generally at their downstream ends promotes reliable and versatile use of the present pumping apparatus. As will be recognized by those familiar with the art, it is sometimes necessary to employ a pumping apparatus in a processing stream in which a vacuum is established and maintained generally at the upstream, infeed portion of the pumping apparatus. For example, such an arrangement is sometimes necessary in the processing of certain cheeses.

In a conventional pumping apparatus wherein the driving of its screw augers is effected generally at their upstream ends, it will be appreciated that dynamic drive shaft seals are required to effectively seal the vacuum established generally at the infeed of the pump. However, the construction and nature of dynamic seals is such that it is typically more difficult to dynamically seal a shaft against a vacuum, as opposed to dynamically sealing the shaft against positive pressure. Thus, the illustrated arrangement of the present pumping apparatus 10 wherein the driving of the auger means 21A and 21B is effected at their downstream ends very desirably permits the use of positive pressure dynamic seals at the drive shafts, since the region within the pump housing 12 whereat discharge cavity 17 is defined is subjected to positive pressure attendant to pump operation.

In the preferred embodiment illustrated, the first stage auger means 20A and 20B are located above, and preferably longitudinally aligned with, the axis of respective ones of the second stage auger means 21A and 21B. Preferably, each first stage auger means 20A and 20B is integral with, and extends coaxially from, the upstream end of the second stage auger mean 21A and 21B, respectively. To this end, each second stage auger means 21A and 21B has an auger core 42 extending longitudinally in the second stage region 102, and auger means 21A includes a projection 38A extending into the first stage region 101 while auger means 21B includes a projection 38B extending into the first stage region 101. The extensions 38A and 38B function as the cores of the first stage first auger means 20A and second auger means 20B, respectively.

The first stage auger means 20A has a non-positive displacement helical flight means 36A configured around the first stage auger means vertical axis for providing non-positive displacement pumping and for providing a net positive suction head at the interface of the first stage region 101 and second stage region 102.

The first stage helical flight means 36A extends outwardly from the first stage auger means core 38A. A portion of the periphery of the first stage helical flight means 36A may be characterized as defining a volume envelope around which is disposed a portion of the pump housing 12 defining the first stage region 101.

In the preferred embodiment illustrated, the first stage non-positive displacement helical flight means 36A tapers radially inwardly and decreases in radial dimension in the downstream direction so that the periphery of the flight means 36A decreases in the direction of gross movement through the apparatus first stage region 101. As illustrated, the pump housing 12 in the first stage region 101 is generally tapered around a major portion of the first stage flight means 36A. The upper part of the housing in the first stage region 101 has a cross section of decreasing dimension in the direction corresponding to the direction of gross movement of the material through the pump first stage region 101.

In other forms of the apparatus, the upper distal end of the first stage auger means core 38A may be tapered or pointed so as to promote "piercing" of material which is being fed by gravity into the pumping apparatus 10. This could reduce problems of "tunneling" and "bridging," such as have been common with some pump constructions, without resort to additional driven feed rollers or the like.

Further, the first stage flight means 36A may alternatively have a constant peripheral diameter along an upper portion of the longitudinal length of the core 38A in the first stage region 101. Further, the core 38A may have a configuration other than the cylindrical configuration illustrated. For example, the core 38A may have a frustoconical shape with the larger diameter portion located at the top opening 14 or, alternatively, with the larger diameter portion located at the bottom of the first stage region 101.

It will also be appreciated that the helical flight means 36A in the first stage region 101 may have a decreasing pitch to desirably provide progressively increasing pressures in the direction of material movement within the first stage region 101.

As will be recognized, the first stage flight means 36A is preferably configured as a so-called Archimedean screw to provide a non-positive pumping action. In other words, the configuration of the flight means 36A acts to urge material downwardly within the first stage region 101 in the pump housing 12, but does not provide a positive pumping displacement such as in the nature of pumps having cooperating multi-lobular rotors or the like.

The first stage second auger means 20B has a non-positive displacement helical flight means 36B configured around the first stage second auger means vertical axis for providing non-positive displacement pumping and for providing a net positive suction head at the interface of the first stage region 101 and second stage region 102.

Figure 6:
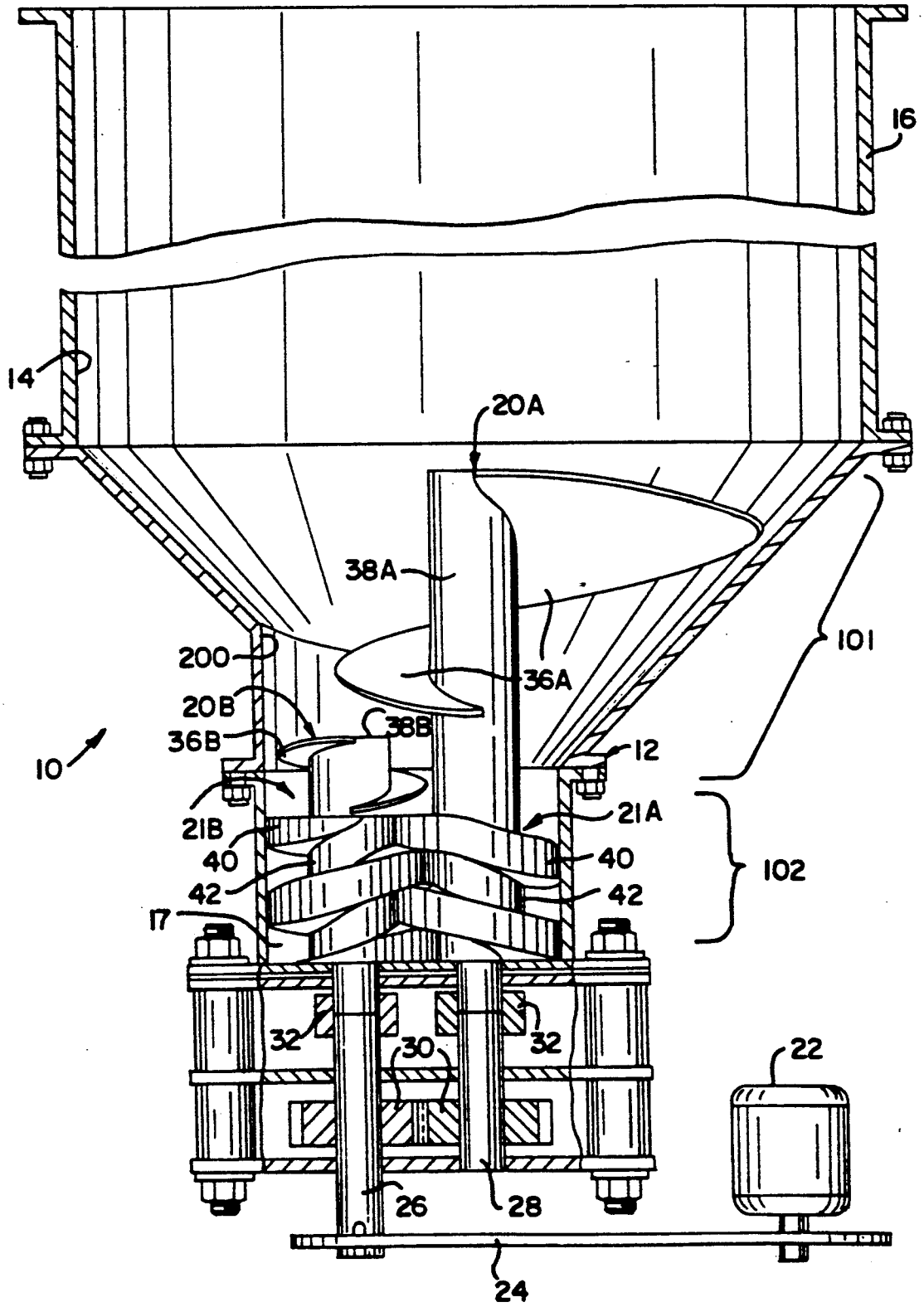
FIG. 6 is a view similar to FIG. 1, but showing a modification with the upstream end of the flight means 36B spaced below the downstream end of the flight means 36A.

The helical flight means 36B extends outwardly from the auger means core 38B and may have a configuration generally analogous to the helical flight means 36A described above. However, the flight means 36B, in the preferred embodiment illustrated, is preferably substantially smaller than the flight means 36A. Further, the upstream end of the flight means 36B terminates at a point that is at or below the downstream end of the helical flight means 36A. FIG. 1 illustrates the upstream end of the flight means 36B at substantially the same elevation as the downstream end of the flight means 36A. Of course, the upstream end of the flight means 36B could instead be spaced somewhat downstream of (i.e., below) the downstream end of the flight means 36A as shown in the modification illustrated in FIG. 6. Thus, as can be seen in FIG. 1, the flight means 36A may be characterized as being axially displaced relative to the flight means 36B. Further, the flight means 36A extends laterally over at least a portion of the second auger means 20B.

Because of the axially displaced relationship between the helical flight means 36A and the helical flight means 36B, it will be appreciated that the two flight means do not intermesh. Thus, assembly of the pumping apparatus is made considerably easier. Similarly, disassembly is greatly facilitated.

Further, because the flight means 36A is above, and extends laterally outwardly over, the upper end of the second auger means 20B, the material can be moved by the first auger means 20A down onto the second auger means 20B without obstruction.

Further, the housing 12 around the first stage 101 includes a partially cylindrical portion 200 (FIGS. 2 and 4), and the partially cylindrical portion 200 communicates with the adjacent tapering portion of the housing 12. This provides an open and generally unobstructed flow passage for the material as it flows through the first stage 101 and into the second stage 102. Compared to other designs, this accommodates the flow of the material with a substantially lower pressure drop.

While the first stage auger means 20A and 20B provide a non-positive displacement action in the first stage region 101, the auger means 21A and 21B in the lower, downstream second stage region 102 have each been specifically configured to provide a positive displacement pumping. As will be observed, each auger means 21A and 21B has a positive displacement helical flight means 40. The flight means 40 of the auger means 21A is configured to closely conform and mesh with the flight 40 means and core 42 of the auger means 21B. In operation, this provides a positive displacement pumping action, much in the nature of a positive displacement pump having lobular rotors. Close conformance of the pump housing 12 to the peripheries of flight means 40 in the second stage region 102 promotes this positive displacement action.

Thus, the present arrangement desirably provides two pumping stages in immediate succession while still employing means which can be driven together by but a single drive.

In view of the positive displacing nature of the second stage auger flight means 40, it may be preferred in some situations that these flight means 40 terminate in spaced relation to the end of the interior of pump housing 12 to thus define a lower discharge cavity (not illustrated). This arrangement could help to prevent inadvertent jamming of the auger means 21A and 21B which might otherwise occur in some situations in view of the positive displacing nature of second stage flight means 40.

By locating the first and second stage pumping regions 101 and 102 in substantially immediate succession, significant pressure drop at the transition is desirably avoided. A significant pressure drop at the interface of the first and second stage pumping regions 101 and 102 is further avoided by configuring each second stage auger means core 42 to be of the same diameter as the lower end of the respective first stage auger means cores 38A and 38B. Streamlined flow is thus promoted.

Further, the non-positive first stage region 101 desirably acts to create a net positive suction head at the second stage region 102, thereby avoiding "starving" the second stage and causing cavitation. To further avoid cavitation in the second stage region 102, the first stage flight means 36A and 36B can preferably be configured to provide a slight "overfeeding" (i.e., supply an excess of material) to the second stage flight means 40. The degree of overfeeding which the flight means 36A and 36B are designed to provide is preferably selected in accordance with the specific application of the pumping apparatus and material being pumped.

With the design of the present invention, material tends to advantageously be pumped through the apparatus 10 in a "first in-first out" manner. This is particularly well suited for use in pumping food materials.

Further, the shaped first stage region 101 of the pump housing 12 and the complementary shape of the first stage auger means 20A and 20B provide an improved material transport through the pump.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A two-stage pumping apparatus comprising:

a pump housing through which material is pumped, said housing defining (1) a material infeed opening, (2) a first stage non-positive displacement pumping region communicating with said infeed opening, (3) a second stage positive displacement pumping region downstream of, and communicating with, said first stage region, and (4) at least one material discharge opening communicating with said second stage region;

first stage first and second auger means in said first stage region each rotatable about respective parallel axes for moving material along said first stage region and each having non-positive displacement helical flight means for providing non-positive displacement pumping and a net positive suction head at the interface of said first and second stage regions, said helical flight means of said first stage first auger means being axially displaced relative to said helical flight means of said first stage second auger means, the upstream end of said helical flight means of said first stage second auger means terminating at or spaced downstream of the downstream end of said helical flight means of said first stage first auger means, said helical flight means of said first stage first auger means extending laterally over at least a portion of said first stage second auger means;

second stage first and second positive displacement auger means extending in said second stage region rotatable together about respective parallel axes for moving said material along said second stage region from said first stage region downstream to said material discharge opening, each of said second stage auger means having positive displacement helical flight means configured for engaging said material and for being respectively intermeshed with the positive displacement helical flight means of the other one of said second stage auger means for providing positive displacement pumping; and drive means for rotatably driving said second stage auger means and said first stage auger means.

2. The apparatus in accordance with claim 1 in which a portion of the interior periphery of said pump housing in said first stage region is configured to extend along said first stage first auger means in general conformity with a portion of the volume envelope defined by the periphery of said first stage first auger means non-positive displacement helical flight means.

3. The apparatus in accordance with claim 1 in which said pump housing defines said material infeed opening in an orientation relative to said first stage auger means to facilitate said gravity infeed of material in a direction generally axially of said first stage auger means, said infeed opening being generally aligned with the axes of said first stage first and second auger means so that a component of the direction of material movement through said infeed opening is parallel with the axes of first stage first and second auger means.

4. The apparatus in accordance with claim 1 in which said infeed opening has a circular configuration in a plane normal to said first stage first and second auger means axes.

5. The apparatus in accordance with claim 1 in which said drive means includes drive coupling means operatively connected with said second stage auger means generally at the downstream ends thereof.

6. The apparatus in accordance with claim 1 in which said first stage first and second auger means are integral with, and extend coaxially from, the upstream ends of said second stage first and second auger means, respectively.

7. The apparatus in accordance with claim 1 in which said driving means rotatably drives said second stage first and second auger means in counter-rotating relation to each other.

8. The apparatus in accordance with claim 1 in which each said first stage first and second auger means comprises a generally cylindrical core outwardly from which the respective helical flight means extends.

9. The apparatus in accordance with claim 1 in which said pump housing is oriented to accommodate the gross movement of said material generally in the direction of gravity.

10. A two-stage pumping apparatus comprising:

a pump housing through which gross movement of material occurs generally in the direction of gravity, said housing defining (1) a material infeed opening in an orientation for gravity infeed of material into said pumping apparatus and (2) at least one material discharge opening;

first and second positive displacement stage auger means extending within said pump housing, said positive displacement stage auger means being rotatable together about respective parallel axes for moving material in said housing along said positive displacement stage auger means downstream to said material discharge opening, each of said positive displacement stage auger means having positive displacement helical flight means for engaging said material and for being respectively intermeshed with the positive displacement helical flight means of the other one of said positive displacement stage auger means, said positive displacement helical flight means of each positive displacement stage auger means being configured within said pump housing for providing positive displacement pumping;

first and second non-positive displacement stage auger means extending axially above said first and second positive displacement stage auger means, respectively, within said pump housing and being rotatable about respective ones of said parallel axes for moving material in said housing along said non-positive displacement stage auger means, each said non-positive displacement stage auger means having a non-positive displacement helical flight means configured for providing a non-positive displacement pumping and a net positive suction head for said positive displacement helical flight means, said non-positive displacement helical flight means of said first non-positive displacement stage auger means being axially displaced relative to said non-positive displacement helical flight means of said second non-positive displacement stage auger means, the upstream end of said helical flight means of said second non-positive displacement stage auger means terminating at or spaced downstream of the downstream end of said helical flight means of said first non-positive displacement stage auger means, said helical flight means of said first non-positive displacement stage auger means extending laterally over at least a portion of said second non-positive displacement stage auger means;

said pump housing defining said material infeed opening in an orientation relative to said non-positive displacement stage auger means to facilitate said gravity infeed of material in a direction generally axially of said non-positive displacement stage auger means; and drive means for rotatably driving said positive displacement stage auger means and said non-positive displacement stage auger means.

11. The apparatus in accordance with claim 10 in which said infeed opening has a circular configuration in a plane normal to said non-positive displacement stage auger means axes.

12. The apparatus in accordance with claim 10 in which said drive means includes drive coupling means operatively connected with said positive displacement stage auger means generally at the downstream ends thereof.

13. The apparatus in accordance with claim 10 in which said non-positive displacement stage auger means are integral with, and extend coaxially from, the upstream ends of said first and second positive displacement stage auger means, respectively.

14. The apparatus in accordance with claim 10 in which said driving means rotatably drives said positive displacement stage auger means in counter-rotating relation to each other.

15. The apparatus in accordance with claim 10 in which each said non-positive displacement auger means comprises a generally cylindrical core outwardly from which the respective helical flight means extends.

16. A method for pumping difficultly flowable material which comprises the steps of introducing said material into an infeed opening of a housing that has infeed and discharge openings generally at opposite ends and through which said material is pumped; rotating a first helical flight means about a first axis for engaging said material in a first stage region of said housing; rotating a second helical flight means for engaging said material in said first stage region of said housing with said second helical flight means located (1) to rotate about a second axis spaced from, and parallel to, said first axis and (2) to extend at least partially under, said portion of said first helical flight means; moving said material through the first stage region to a second stage region by the action of said first and second helical flight means effecting non-positive displacement pumping, thereafter moving said material through the second stage region by rotating a pair of helical flight means for engaging said material in said second stage region to effect positive displacement pumping, and thereafter discharging said material through said discharge opening.

17. The method in accordance with claim 16 including the step of orienting the pump housing generally vertically to accommodate gross movement of said material generally in the direction of gravity.

18. The apparatus in accordance with claim 1 in which the upstream end of said helical flight means of said first stage second auger means terminates downstream of the downstream end of said helical flight means of said first stage first auger means.

19. The apparatus in accordance with claim 1 in which the upstream end of said helical flight means of said first stage second auger means terminates at the downstream end of said helical flight means of said first stage first auger means.

20. The method in accordance with claim 16 in which the upstream end of said second helical flight means terminates at or spaced downstream of the downstream end of said first helical flight means.

* * * * *